United States Patent [19]

Piazzola

[11] 4,062,391

[45] Dec. 13, 1977

[54] SAFETY GUARD

[76] Inventor: Vincent Piazzola, 217 Faithway Drive, Seffner, Fla. 33584

[21] Appl. No.: 740,811

[22] Filed: Nov. 11, 1976

[51] Int. Cl.[2] ..... B27G 21/00

[52] U.S. Cl. ..... 144/251 A; 51/268; 90/11 R; 90/DIG. 16; 408/241 G

[58] Field of Search ..... 408/241 G; 144/251 R, 144/251 A, 134 R, 134 A, 136 R, 252 R; 90/11 R, 11 A, DIG. 16; 51/268, 269, 274

[56] References Cited

U.S. PATENT DOCUMENTS 727,530 5/1913 Forster ..... 144/251 R 2,742,063 4/1956 Bretthauer ..... 144/251 R

*Primary Examiner*—Harrison L. Hinson
*Assistant Examiner*—W. D. Bray
*Attorney, Agent, or Firm*—Arthur W. Fisher, III

[57] ABSTRACT

A safety guard for use with a woodworking machine comprising a transparent enclosure configured to substantially enclose the cutting tool of the woodworking machine. An elongated pressure member is formed on the lower portion of the outer wall to engage the workpiece. A plurality of inclined interrupted teeth extend along the lower edge of the elongated pressure member to engage the workpiece to prevent the workpiece from being thrown back into the operator.

6 Claims, 2 Drawing Figures

SAFETY GUARD

BACKGROUND OF THE INVENTION

1. Field of the Invention

A safety guard for use wih a woodworking machine to prevent injuries to operators of such machines.

2. Description of the Prior Art

Numerous types of woodworking machines have been developed. Both cutting and shaping machines commonly have cutting tools which rotate at speeds in excess of 5,000 revolutions per minute. Under stress, these cutting tools may fracture and break or simply become dislodged from the machine. Obviously such high speed projectiles are dangerous to both life and limb. Moreover, an open or exposed cutting tool can easily disfigure and dismember an operator. Thus various efforts have been made to guard against such dangers.

One such example relates to table saws with fixed guards extending over the saw or cutting element. They are movably mounted in such a manner to permit inspection or adjustment. Unfortunately however, for many purposes the guards form an obstruction so that many operations are performed with the guard removed. Moreover, the manner in which such guards are supported from the table make it troublesome to remove and replace. As a result there is a tendency for the operator to remove the guard and operate without it.

Another problem exists where an operator feeds a piece of wood to the cutting tool. The cutting tool will naturally exert a tremendous back pressure upon the wood thereby kicking it rearwardly with terrific force. This rearward movement may result in injury or death.

These safety guards are complicated to manufacture and use. Thus a need exists in the industry for such a safety guard that is simple to manufacture and to use and effectively performs all the tasks of effectively catching and stopping a workpiece which is thrown back as well as the cutting tool itself.

SUMMARY OF THE INVENTION

The present invention relates to a safety guard for use with a woodworking machine. More specifically, the safety guard comprises an enclosure to substantially enclose the cutting tool of the woodworking machine. The cutting tool may comprise any conventional machine cutter or bench saw normally used in cutting and moulding wood. Inasmuch as these cutting tools are under stress there is a constant danger of pieces breaking off the machine causing injury or death to machine operators. Moreover, the lack of a guard around the cutting tool has been known to cause mutilating accidents to operators' hands and fingers when they have accidentally made contact with the cutting tool. The purpose of the instant safety guard is to prevent accidents of this nature as well as provide a pressure plate as more fully described hereinafter.

The enclosure comprises a substantially horizontal base plate, substantially vertical pressure plate and a pair of L-shaped end plates. The safety guard can be fitted to the woodworking machine in various manners. One such method comprises a pair of slotted apertures formed in the base to receive bolts passed therethrough. The opposite ends of the bolts are attached to the fence which forms a guide for the workpiece. Flat washers are then placed on opposite sides of the slotted apertures and fastening means are tightened against the washers to hold the safety guard secure and at the correct height and lateral position.

An elongated pressure member is formed on the lower portion of the pressure plate to engage the workpiece. A plurality of inclined interrupted teeth is formed along the lower surface of the pressure member to prevent the workpiece from being thrown back into the operator. The inclined interrupted teeth extend along the line of the workpiece advance. The safety guard will best work if the teeth are inclined downwardly and at a slight angle in the same direction that the workpiece moves through the machine. In this configuration, if the workpiece is thrown back by the machine, it will most easily engage the teeth and thus be prevented from being thrown back into the operator.

Since the safety guard substantially encloses the cutting tool, it is important that the operator of the machine be able to see the cutting tool so that he can adequately and safely perform his work. It is also important that the safety guard be able to withstand shock, vibration and impact. The safety guard therefore comprises a transparent material with sufficient strength and toughness to withstand the shock, vibration and impact which may be encountered during the operation of the machine.

Once the safety guard is positioned securely in place, is substantially encloses the cutting tool to prevent serious injury or death which may result from the operator's hands accidentally coming in contact with the cutting tool or pieces that may fly off the machine. The elongated pressure member engages the workpiece along the direction of advance and the plurality of inclined teeth prevent the workpiece from being thrown back into the operator.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
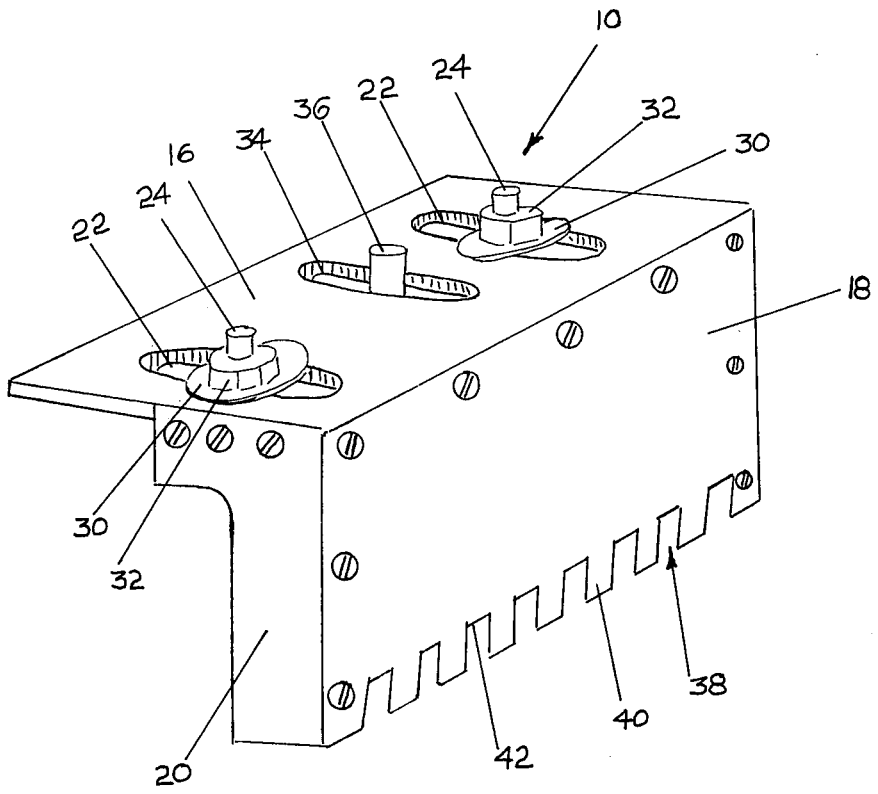
FIG. 1 is a perspective view of a safety guard.
Figure 2:
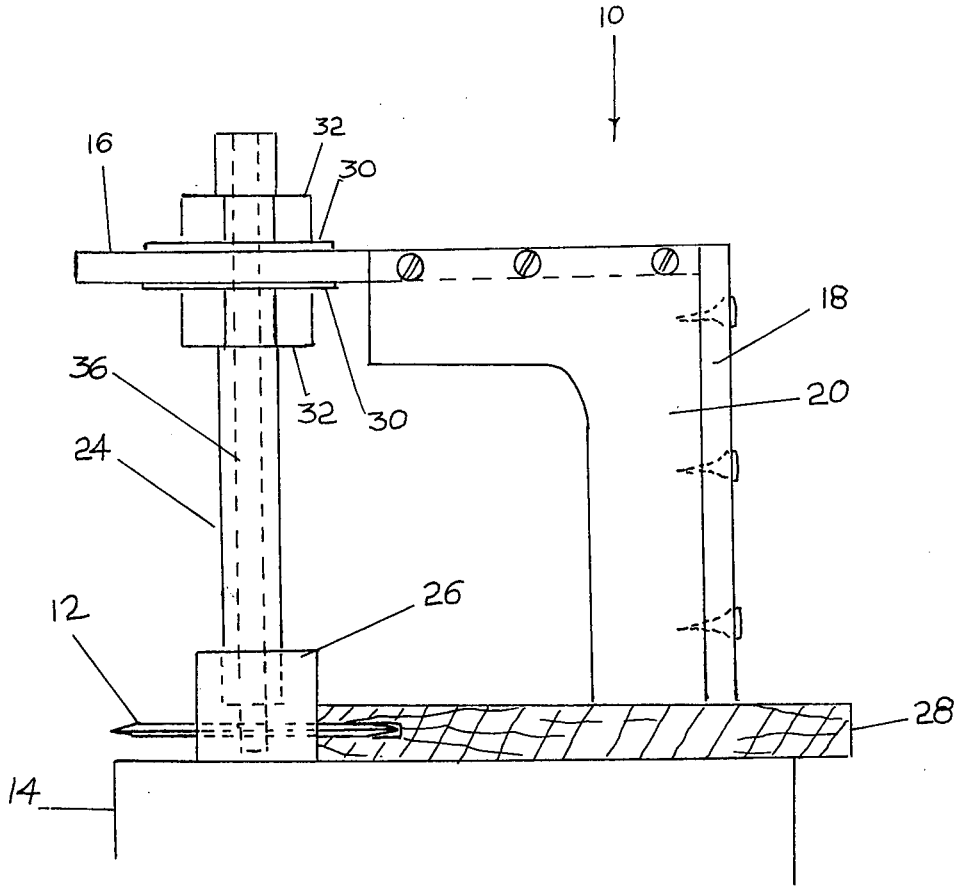
FIG. 2 is an end view of the safety guard.

A shown in FIGS. 1 and 2, the safety guard of the present invention comprises an enclosure generally indicated as 10 specifically configured to substantially enclose the cutting tool 12 of a woodworking machine 14. The safety guard is structured to provide protection in the woodworking industry for spindle moulding and wood shaper machines and the like. The safety guard 10 is structured to be fixedly attached to the woodworking machine 14 as described more fully hereinafter.

The cutting tool 12 may comprise any conventional machine cutter or bench saw normally used in cutting and moulding wood. As normally found in the woodworking industry, these cutting tools rotate at velocities in excess of 5,000 revolutions per minute. Since under stress, these cutting tools may break or fly off the machine causing injury or death to machine operators.

Moreover, the lack of a guard around the cutting tool 12 has been known to cause mutilating accidents to operators' hands and fingers when they have accidentally made contact with the cutting tool. The purpose of the instant safety guard 10 is to prevent accidents of this nature by substantially enclosing the cutting tool 12 as well as provide a pressure plate to hold down the workpiece as more fully described hereinafter.

As shown, the enclosure comprises a substantially horizontal base plate 16, substantially vertical pressure plate 18 and a pair of L-shaped end plates 20. The end plates 20 are attached to opposite ends of plates 16 and 18 by any suitable means.

The safety guard 10 can be fitted to the woodworking machine 14 in various manners. One such method is shown in FIGS. 1 and 2 wherein a pair of slotted apertures 22 are formed in the base plate 16. Bolts 24 are passed through the slotted apertures 22. The opposite ends of the bolts 24 are attached to the fence 26. The fence 26 forms a guide for the workpiece 28. Flat washers 30 are then placed on opposite sides of the slotted apertures 22 and hex nuts or fastening means 32 are tightened against the washers 30 to hold the safety guard 10 secure and at the correct height and lateral position. A third slotted aperture 34 is formed in the base plate 16 to receive the upper end of the spindle 36 which supports the cutting tool 12.

An elongated pressure member generally indicated as 38 is formed on the lower portion of the pressure plate 18 to engage the workpiece 28. In most conventional machines, awkward spring hold downs which hinder the machine operators in performing their functions are used. A plurality of inclined interrupted teeth 40 is formed along the lower surface 42 of the pressure member 38 to prevent the workpiece 28 from being thrown back into the operator. The inclined interrupted teeth 40 extend along the line of the workpiece advance. The safety guard will best work if the teeth 40 are inclined downwardly and at a slight angle from 10 degrees in the same direction that the workpiece 28 moves through the machine 14. In this configuration, if the workpiece is thrown back by the machine 15, it will engage the teeth 40 and thus be prevented from being thrown back into the operator.

Since the safety guard 10 substantially encloses the cutting tool 12, it is important that the operator of the machine 14 be able to see the cutting tool 12 so that he can adequately and safely perform his task. It is also important that the safety guard 10 be able to withstand shock, vibration and impact. The safety guard 10 therefore comprises a transparent material with sufficient strength and toughness to withstand the shock, vibration and impact which may be encountered during the operation of the machine. Although many suitable materials are available, an acrylic thermoplastic such as "G. E. Lexan" can be used. Even an opaque material such as aluminum or sheet metal may be used if the safety guard 10 as so constructed contains a transparent viewing window comprised of a material previously described which allows visibility of the cutting tool 12 at all times and from all angles. Such a construction is, of course, intended to come within the embodiment of the invention.

Once the safety guard 10 is positioned securely in place as previously described, it substantially encloses the cutting tool 12 to provent serious injury or death which may result from the operator's hands accidentally coming in contact with the cutting tool 12 or pieces from flying off. In operation the elongated pressure member 38 engages the workpiece 28 along the direction of advance and the plurality of inclined teeth 40 prevent the workpiece 28 from being thrown back into the operator.

It will thus be seen that the effects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the ivention which, as a matter of language might be said to fall therebetween.

Now that the invention has been described,

What is claimed is:

1. A safety guard for use with a woodworking machine, said safety guard comprising an enclosure to substantially enclose the cutting tool of the woodworking machine, said enclosure comprising a substantially horizontal base plate, a substantially vertical pressure plate extending downwardly from the outer edge of said substantially horizontal base plate and a pair of end plates attached to opposite ends of said base plate and said pressure plate, said substantially vertical pressure plate having an elongated pressure member formed on the lower portion thereof, said elongated pressure member comprises a plurality of interrupted teeth being held in fixed spaced relation relative to the woodworking machine to engage the workpiece along the direction of travel during operation.

2. The safety guard of claim 1 wherein said plurality of interrupted teeth are inclined along the direction of travel.

3. The safety guard of claim 1 wherein said enclosure is transparent.

4. The safety guard of claim 1 wherein said plurality of interrupted teeth are inclined along the direction of travel and further including means to selectively adjust the vertical separation between the woodworking machine and said elongated pressure member said means to selectively adjust the vertical between the woodworking machine and said elongated pressure member comprises a pair of slots formed in said substantially horizontal base plate, a pair of coresponding vertical supports extending downwardly from through said slots and two pair of fastening means, one pair of fastening means attached to each said vertical support on opposite sides of said base plate, the lower portions of each said pair of corresponding vertical supports being coupled to the woodworking machine, said pair of slots each comprising an elongated aperture to permit lateral adjustment of said enclosure relative to the woodworking machine.

5. The safety guard of claim 1 further including means to selectively adjust the vertical separation between the woodworking machine and said elongated pressure member said means comprising a pair of slots formed in said substantially horizontal base plate, a pair of corresponding vertical supports extending downwardly through said slots and two pair of fastening means, one pair of fastening means attached to each said vertical support on opposite sides of said base plate, the lower portion of each said pair of corresponding vertical supports being coupled to the woodworking machine.

6. The safety guard of claim 5 wherein said pair of slots each comprises an elongated aperture to permit lateral adjustment of said enclosure relative to the woodworking machine.

* * * * *